US010368619B2

(12) United States Patent
Richards et al.

(10) Patent No.: US 10,368,619 B2
(45) Date of Patent: Aug. 6, 2019

(54) TRAVEL BAG

(71) Applicant: Nomatic, LLC, Cottonwood Heights, UT (US)

(72) Inventors: Jon Richards, Salt Lake City, UT (US); Jacob Durham, Salt Lake City, UT (US)

(73) Assignee: Nomatic, LLC, Cottonwood Heights, UT (US)

( * ) Notice: Subject to any disclaimer, the term of this patent is extended or adjusted under 35 U.S.C. 154(b) by 0 days.

(21) Appl. No.: 15/621,849

(22) Filed: Jun. 13, 2017

(65) Prior Publication Data

US 2018/0352923 A1 Dec. 13, 2018

(51) Int. Cl.

| | |
|---|---|
| ***A45F 4/02*** | (2006.01) |
| ***A45C 9/00*** | (2006.01) |
| ***A45F 3/04*** | (2006.01) |
| ***A45C 3/00*** | (2006.01) |
| ***A45C 13/10*** | (2006.01) |
| ***A45C 5/03*** | (2006.01) |

(52) U.S. Cl.

CPC ..... *A45C 9/00* (2013.01); *A45C 3/00* (2013.01); *A45C 5/03* (2013.01); *A45C 13/10* (2013.01); *A45F 3/04* (2013.01); *A45F 3/047* (2013.01); *A45F 4/02* (2013.01); *A45C 2003/008* (2013.01); *A45C 2009/007* (2013.01)

(58) Field of Classification Search

CPC ..... A45F 4/02; A45F 2004/023; A45F 3/047; A45C 2009/007; A45C 9/00; A45C 3/00; A45C 5/03; A45C 13/10; A45C 3/04; A45C 2003/008

USPC ..... 224/578–579, 153, 576, 580

See application file for complete search history.

(56) References Cited

U.S. PATENT DOCUMENTS

| | | | | | |
|---|---|---|---|---|---|
| 3,802,613 | A * | 4/1974 | Droeger | A45F 3/04 | 224/153 |
| 5,181,638 | A * | 1/1993 | McHale | A45F 3/047 | 224/259 |
| 5,577,652 | A * | 11/1996 | Cooper | A45F 3/02 | 224/153 |
| 6,286,461 | B1 * | 9/2001 | Martz | A01K 1/0254 | 119/497 |
| 7,431,184 | B2 * | 10/2008 | Gregory | A45F 3/04 | 224/627 |
| 7,909,215 | B2 * | 3/2011 | McGuire | A45C 13/30 | 206/315.3 |
| 8,746,523 | B1 * | 6/2014 | Woolley | A45C 13/30 | 224/578 |

(Continued)

*Primary Examiner* — Adam J Waggenspack

(74) *Attorney, Agent, or Firm* — Durham Jones & Pinegar, P.C., Intellectual Property Law Group

(57) ABSTRACT

A travel bag, or bag capable of being positioned in multiple configurations to allow a user to carry the bag in a plurality of ways. The bag may include straps secured to the bag in such a manner as to allow a user to easily manipulate the straps into a first configuration and a second configuration. The first configuration may be in a backpack type configuration where a user may place the straps around his/her arms and shoulders to carry the bag on the back of the user. The second configuration may be in a duffle bag type configuration where a user may hold the straps in a single hand or arm. The straps may pass freely through a clip anchored to the bag allowing the bag to easily transition from the first configuration to the second configuration.

11 Claims, 8 Drawing Sheets

(56) References Cited

U.S. PATENT DOCUMENTS

| | | | | |
|---|---|---|---|---|
| 2004/0065708 | A1* | 4/2004 | Amram | A45F 3/047<br>224/579 |
| 2008/0210727 | A1* | 9/2008 | Gallaway | A45C 13/02<br>224/575 |
| 2011/0284598 | A1* | 11/2011 | Lawson | A45C 3/001<br>224/153 |

* cited by examiner

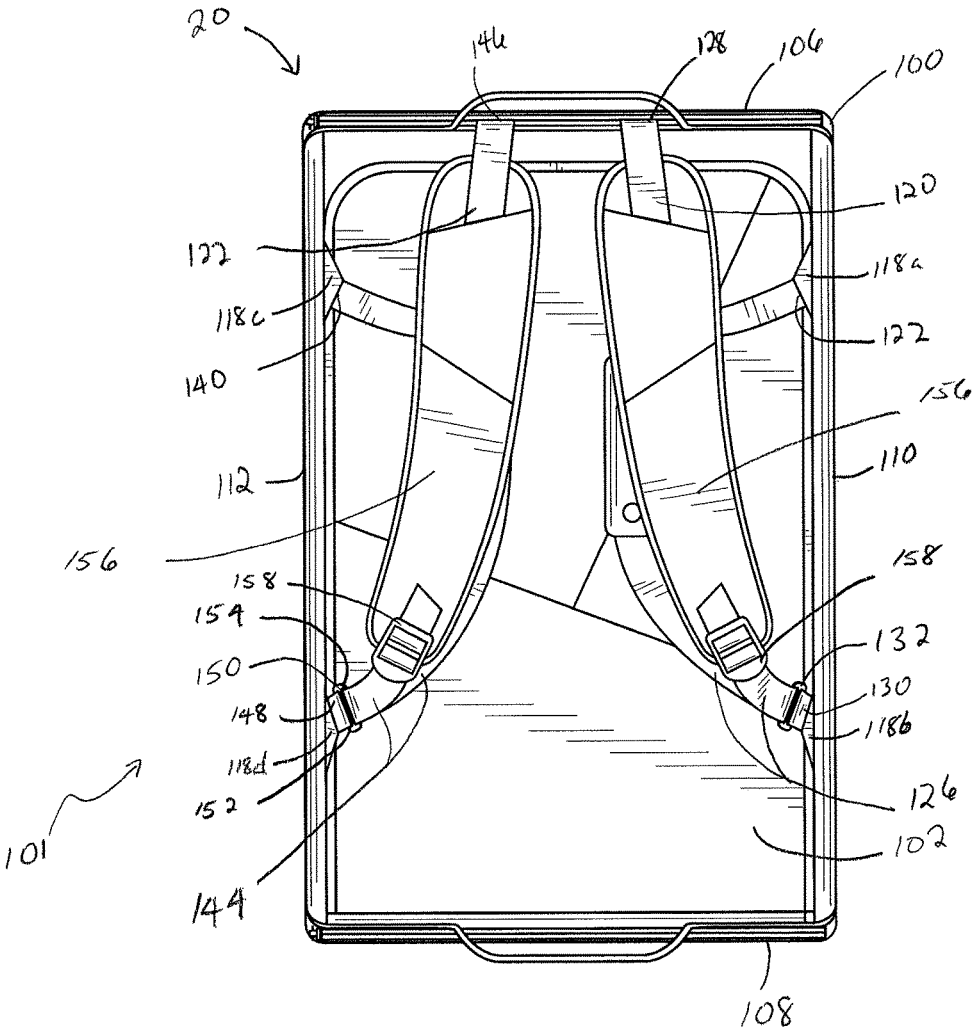
FIG. 2
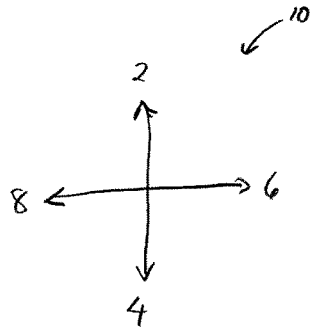

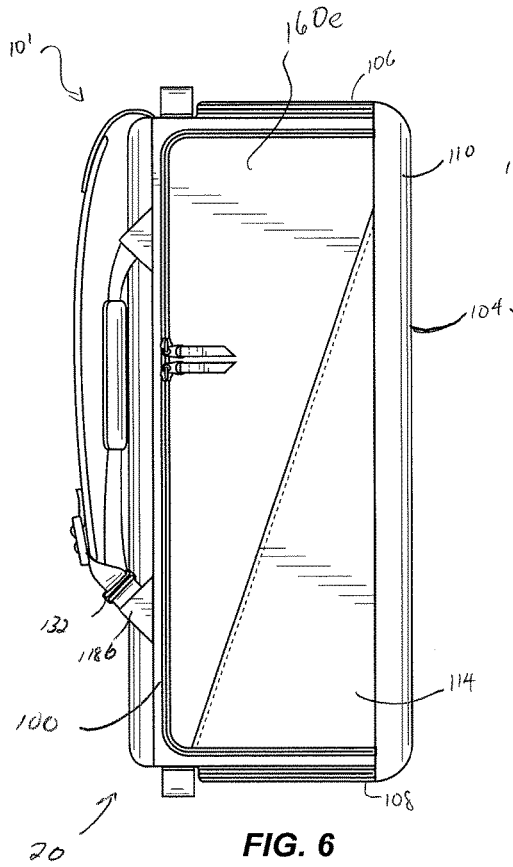
FIG. 6
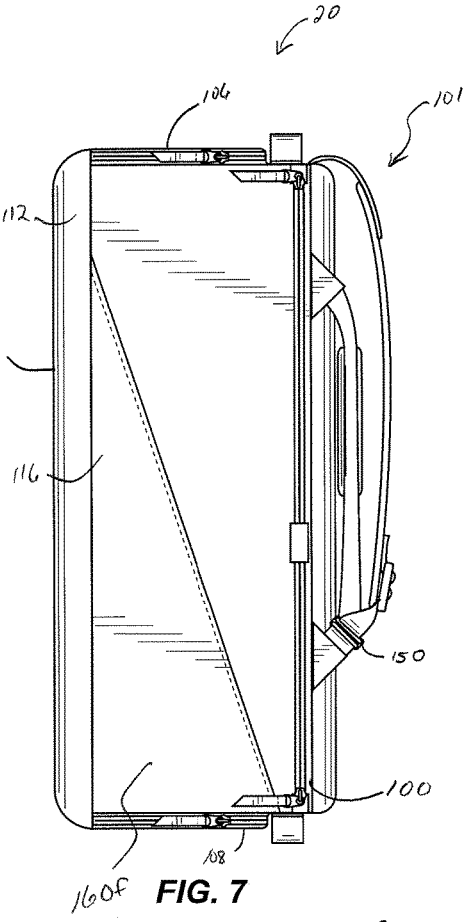
FIG. 7
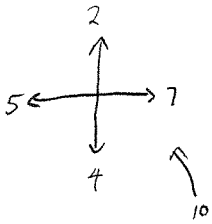
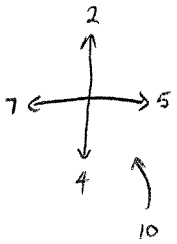

TRAVEL BAG

FIELD

This disclosure relates generally to a strap design for a bag for traveling or carrying items and, more specifically, a travel bag for ease in packing and organizing items for travel and allowing a user to carry the bag as a backpack or as a duffle bag by simple adjustment of the straps. The straps may allow a user to more easily change from a duffle bag to a backpack by utilizing an anchor and clip that allow for easy two-way passage of a strap or straps.

RELATED ART

Many different types of bags used for travel or carrying of items include straps for a user to hold. Some of these travel bags have straps you carry over a shoulder or straps you carry with your hands. The straps of these bags are generally secured to bag. Other instances of travel bags use wheels and handles to allow for easy movement of these bags while transporting the bag, such as walking through airports or to and from any destination.

Backpacks are also well known bags used for carrying items and are often used for travel purposes as well. In some instances, bags will include shoulder straps for a user to place the bag on his back, but the bag is better suited as a duffle bag. In other cases backpacks may include a handle toward the top of the bag, or even to the side of the bag, that allow a user to hand carry the bag, instead of on a user's shoulders.

In yet other bags, a user may be able to easily carry the bag as a duffle bag in a user's hand or a user's shoulder, or change the format of the straps and carry the bag as a backpack with two shoulder straps; however, in these instances, too often the transition between duffle bag to backpack requires changing the straps by unclipping and clipping the straps to different configurations. Other bags may use alternate straps altogether to change from a duffle bag to a backpack. Others may use other fasteners such as snaps or buttons to change the strap configuration, which makes the transition difficult and tedious. Too often a user will only utilize a single function of the bag because it's too difficult to change the strap configuration.

This disclosure provided herein solves the strap configuration problem allowing a user to use a travel bag and easily transition from a hand carry bag to a backpack. In other terms, the following disclosure allows a user to easily utilize the travel bag as a backpack or a duffle bag with easy motion, without additional straps or securing features, and lets the user transition quickly and effectively without fumbling with the bag or the straps.

SUMMARY

This disclosure, in at least one aspect, relates to the use of straps on a bag, and more specifically a travel bag, for carrying clothes, electronics, books, toiletries, or any other travel necessity. More generally, a device, or strap system, secured to a bag that provides easy transition from a duffle bag (or duffle-type bag) to a backpack (or shoulder carry bag).

The device may include a set of straps, anchored at two positions on the bag. The bag may include openings, pockets, sleeves, etc. ("pockets") for carrying a user's items. The pockets may be different shapes and sizes and in different configurations to maximize utilization space for the bag. Certain pockets may be configured to selectively fit certain items a user desires while traveling.

The straps, or set of straps, may be anchored on the exterior of the bag in such a manner to allow a user to lift and carry the bag in a substantially balanced format. The straps may be anchored at one position toward a top of the bag and another position toward a bottom of the bag. One set of straps may be substantially on one lateral side of the bag and another set of straps on the opposite lateral side of the bag.

In a first position, the straps may be equidistant between to anchors at a focal point that allows a user to hold the bag in a relatively level format, like a duffle bag. The straps may include a handle member that wraps around each strap allowing easier carrying by a user.

In a second position, the straps may be pulled in a single direction to allow shoulder straps to extend that may fit a user's shoulders. The user may place the shoulder straps on his/her shoulders and carry the bag like a backpack.

The transition from duffel bag to backpack or from backpack to duffel bag is as simple as pulling one end of the strap, of each strap, to allow for "handle" carry or "shoulder" carry. The straps may pass freely through the clip without unclipping, clipping, snapping, unsnapping, or changing any of the strap anchors. The straps may also be adjusted by a user for a more snug fit as a backpack or a shorter handle grip as a duffle bag.

BRIEF DESCRIPTION OF THE DRAWINGS

These and other features, aspects, and advantages of the present disclosure are better understood when the following Disclosure is read with reference to the accompanying drawings.

FIG. 2 is a rear view of the system or bag of FIG. 1;

FIG. 6 is a first side view of the system, or bag, of FIG. 1;

FIG. 7 is a second side view of the system, or bag, of FIG. 1;

DETAILED DESCRIPTION

Figure 1:
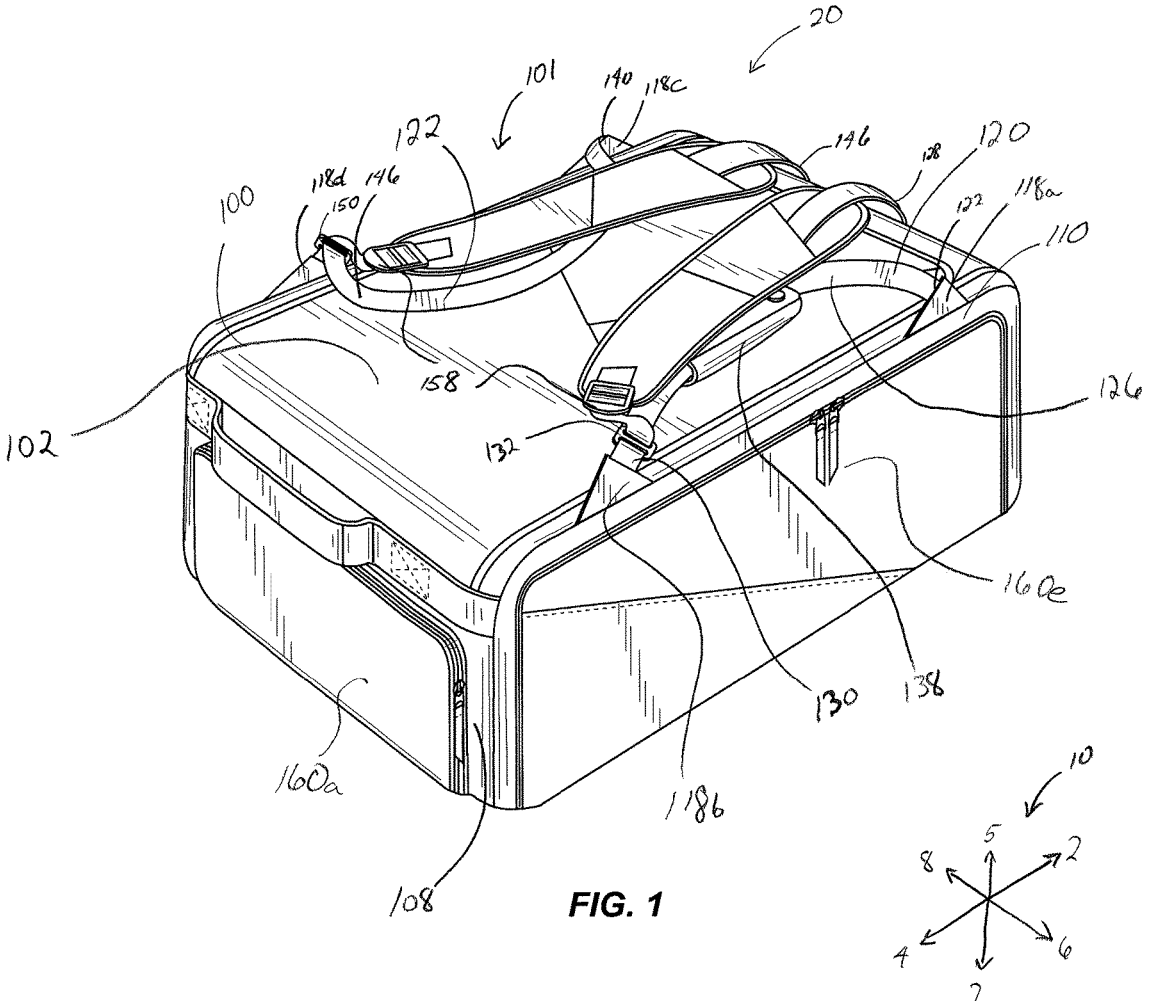
FIG. 1 is a bottom perspective view of a system, or bag, in a first configuration with pockets, straps, and anchors.

The following description sets forth a system, or bag, or travel bag, or duffle bag, or backpack, with a method for easy transition from a duffle bag type bag to a backpack type bag. The system allows for an easy transition from one configuration to another configuration without the need of attaching or detaching straps. This system also does not require additional use of clips, snaps, buttons or the like. A "first configuration" may be referred to as a backpack type configuration where a user may use the bag on his/her back with shoulder straps. A "second configuration" may be referred to as a duffle bag type configuration where a user may handle or carry the bag by holding a strap or straps in his/her hand.

The following description sets forth separate embodiments and methods for utilizing the system and easy transition of the system from the first configuration to the second configuration. The strap or straps may be anchored to the bag in such a manner that the bag easily transforms from backpack to duffle bag.

FIGS. 1-12 figures may be oriented according to the reference arrow diagram 10, having a superior direction 2 (toward a top of the bag), an inferior direction 4 (toward a bottom of the bag), a right lateral direction 6 (toward a right side of the bag), a left lateral direction 8 (toward a left side of the bag), a posterior direction 5 (toward a front of the bag), and an anterior direction 7 (toward a back of the bag). In this application, "left" and "right" are used with reference to a posterior view. "Medial" refers to a position or orientation toward a sagittal plane (i.e., plane of symmetry that separates left and right sides of the bag from each other), and "lateral" refers to a position or orientation relatively further from the sagittal plane.

FIGS. 1 and 2 illustrate at least one embodiment of a system 20, which includes a bag 100 and at least one strap in a first configuration 101. The bag 100 may include a back surface 102, or panel, a front surface 104, or panel, a top surface 106, or panel, a bottom surface 108, or panel, a right surface 110, or panel, and a left surface 112, or panel. The bag 100 may be substantially rectangular cuboid shaped or may be many other possible shapes like a cylinder, a cone, a cube, or the like. The bag 100 may include multiple zippers and pockets that allow for storage of items. The bag 100 may include a first compartment, or void, that is exposed and opened via a zipper that may extend along three (3) sides of the back panel 102. The back panel 102 may open to reveal the compartment, or void, through a large opening within the bag 100 that may allow for storage of items within the void. The void may extend from the back panel 102 to the front panel 104 from the right panel 110 to the left panel 112 and from the top panel 106 to the bottom panel 108.

It will be appreciated that although this disclosure refers to "panels" or "surfaces" that each of those panels or surfaces may be integrated and part of the other panel or surface and the entire bag 100 may be constructed out of a single piece of material with no seams or stops or starts. Alternatively, the bag 100, may be made up of multiple pieces of material secured together via sewing, welding, ultrasonic welding, laser welding, stamp heat welding, hot plate welding, gluing, taping, one piece woven, and other fabric joining techniques known by those having skill in the art.

Handles may separately protrude from the top surface 106 and/or from the bottom surface 108. These handles may allow a user to easily carry or hold onto the bag 100 from a different position on the bag 100.

Referring to FIGS. 6-9, pockets 160 may also be present in or on the bag 100 including multiple pockets 160*a* extending from the bottom panel 108 into the void that may be closed via zipper, snaps, buttons or other means known in the art. Likewise, the top panel 106 may include pockets 160*b-d* extending inward toward the void from the top panel 106. Some of the pockets 160*e-f* may be lined to provide Radio Frequency Identification (RFID) blocking utilizing Mylar or similar material, while other pockets 160*b* may be lined with a water-proof material to allow a use to carry liquid(s) without risking leaking of the liquid into other pockets. Further still, other pockets 160*c* may be mesh while others are solid material, and other pockets 160*d* may be lined with felt so as not to scratch electronics, screens, glasses, or similar. Some pockets 160*a-f* may be expandable and others less flexible, while others may include elastic and others not.

Figure 9:
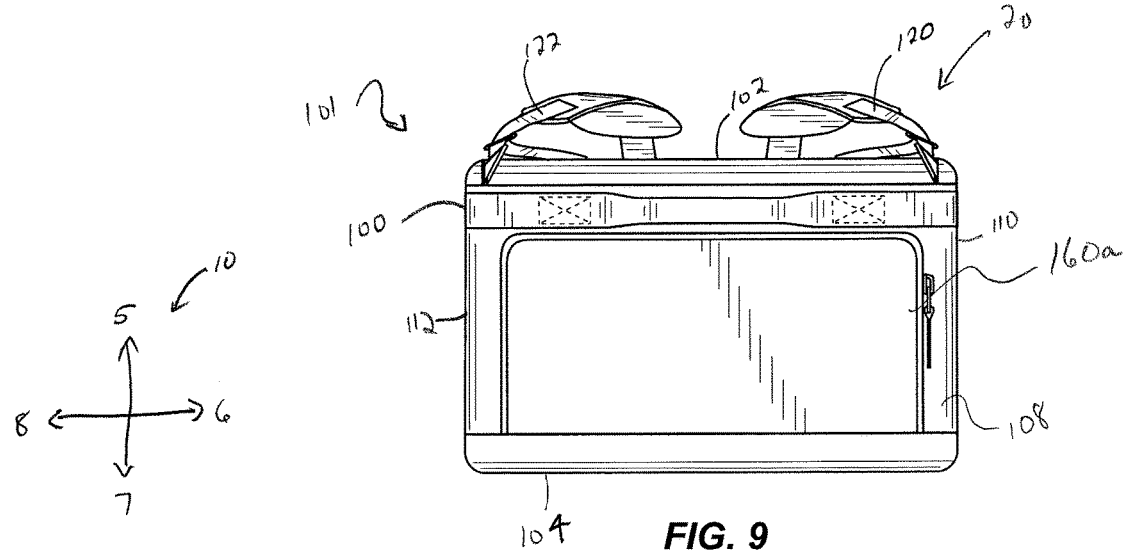
FIG. 9 is a bottom view of the system, or bag, of FIG. 1.
Figure 10:
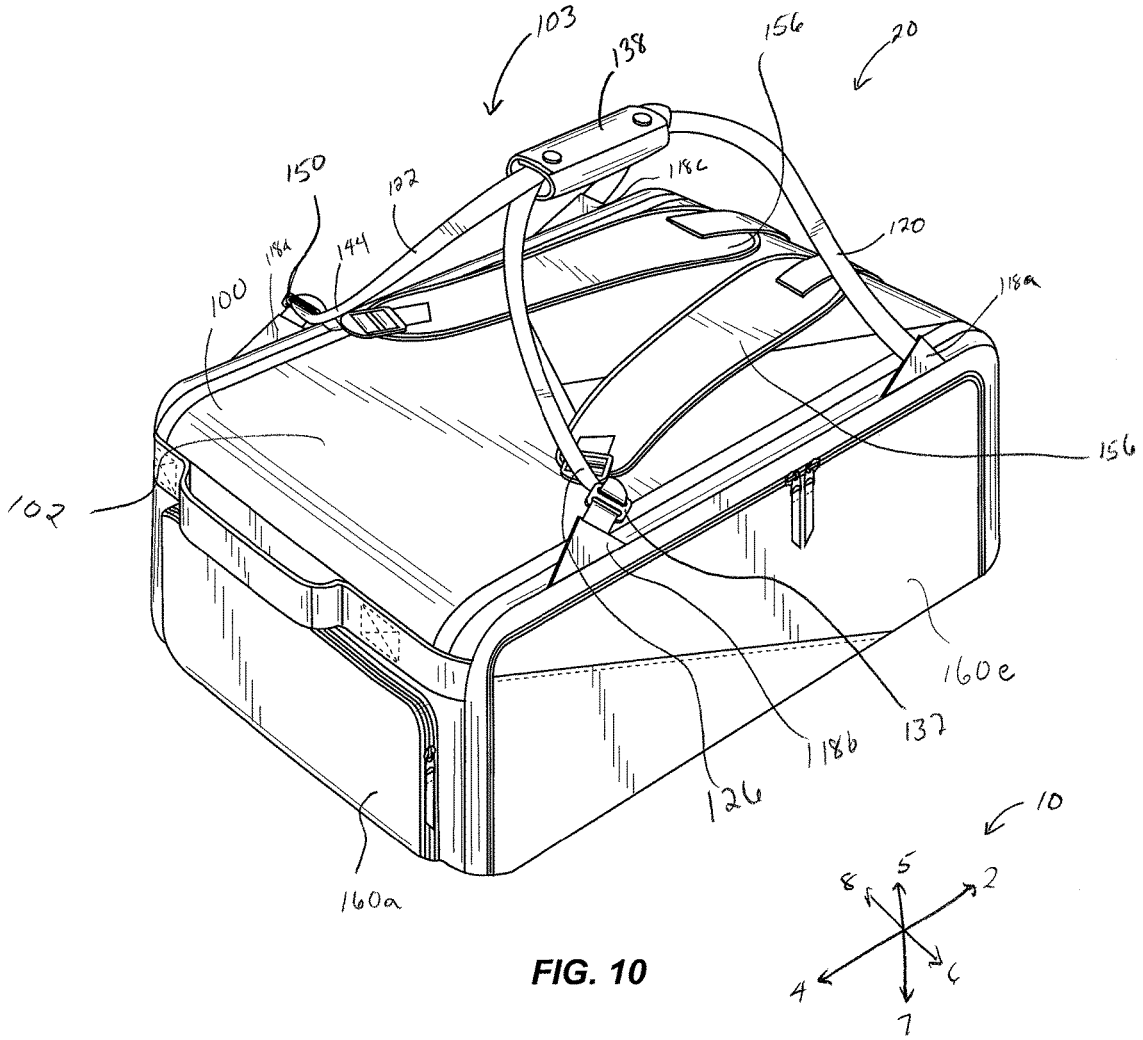
FIG. 10 is a bottom perspective view of the system, or bag, of FIG. 1 with the system in a second configuration.

Referring to FIG. 9, the pocket 160*a* on the bottom panel 108 may be integrated and secured to the bag 100 on one side with a zipper closure that zips the other three (3) sides to secure to the bag 100. The pocket 160*a* on the bottom panel 108 may hold a collapsible mesh bag that is held in the bag 100 via elastic bands that are secured to the pocket 160*a*. The mesh bag may be removable from the pocket 160*a* and expandable to hold other items a user desires, such as dirty laundry. The pocket 169*a* may be large enough to hold at least one pair of shoes and is configured to open widely enough, with the three (3) zippered sides of the pocket 160*a*, for easy access to the pocket 160*a*.

Figure 8:
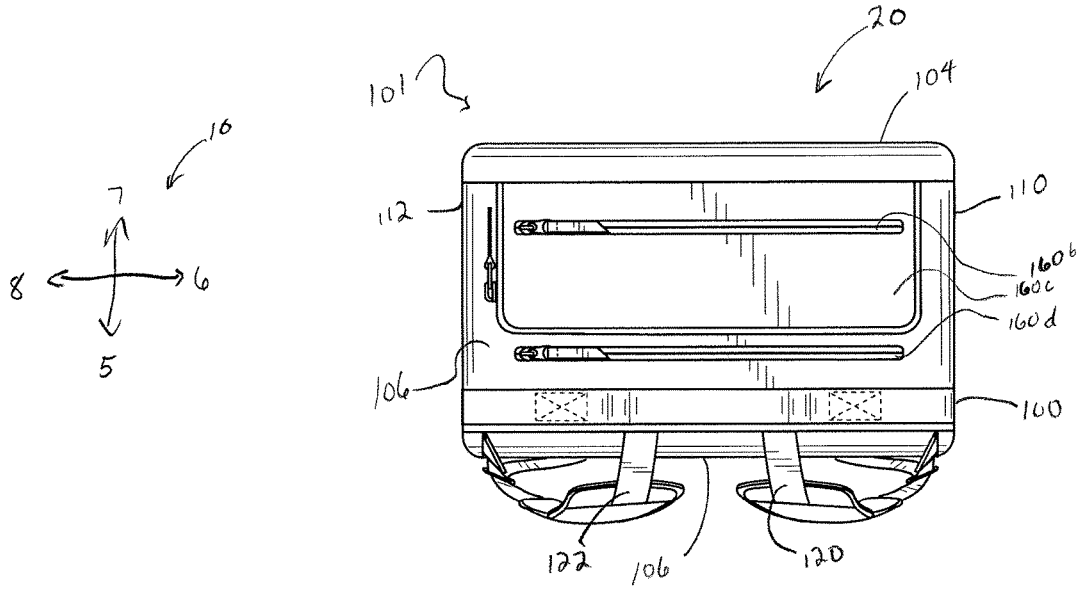
FIG. 8 is a top view of the system, or bag, of FIG. 1.

Referring to FIG. 8, the pockets 160*b-d* on the top panel 106 may include a felt pocket 160*d*, as described earlier and may be zippered closed in a straight line configuration. A second pocket 160*c* may be position on the top panel 106 and may include a pocket similar to the pocket 160*a* on the bottom panel 108 with three (3) zippered sides and one side integrated with the bag 100. The three (3) zippered sides make for easy access getting into and out of the second pocket 160*c* A third pocket 160*b* on the top panel 106 may be lined with a waterproof or water resistant material and may be configured to hold a water-bottle or other liquid bottler therein.

Referring to FIGS. 6 and 7, the right and left panels 110, 112, may have pockets 160*e-f* extending laterally from the panel and away from the void so as not to take any space within the void. The pockets 160*e-f* on the right and left panels 110, 112, may lay flush with the right and left panels 110, 112 when there are no items within the pockets 160*e-f*. However, these pockets 160*e-f* may be elastic in nature to extend and allow for items to be placed therein. The pockets 160*e-f* on the right and left panels 110, 112 may be exposed or may be covered by a first outer cover 114 on the right panel 110 and a second outer cover 116 on the left panel 112. The first outer cover 114 and second outer cover 116 may substantially rectangular in shape and extend from the bottom surface 106 to the top surface 108. The first and second outer covers 114, 116 may be integrated with the bag 100 on a least one side and may be a continuation of the bag 100 on the at least one side. Alternatively, the first and second outer covers 114, 116 may be comprised of a separate piece of material secured to the right and left panels 110, 112, respectively via means already set forth herein. The first and second outer covers 114, 116 may include zippers that engage the right and left panels 110, 112 respectively on at least one side of the outer covers 114, 116. In one embodiment the outer covers 114, 116 may be integrated with the bag on three (3) sides of the outer covers 114, 116, with a zipper extending in one direction to close the pocket or secure the outer covers 114, 116 to their respective panels 110, 112. In another embodiment, wherein the outer covers 114, 116 are only integrated with the bag 100 on a single side the zipper may extend in three directions (e.g. up, across, down) to close a pocket or secure the outer covers 114, 116 to their respective panels, 110, 112. It will be appreciated that multiple variations may be practiced, and are contemplated, to close a pocket with outer covers to a panel in a bag as set forth herein.

The bag 100 may include anchors 118 protruding from the bag 100. Some of the anchors 118 may protrude in a posterior direction and may engage the bag 100 where the back surface 102 and the right surface 110 intersect. Likewise, other anchors 118 may protrude in a posterior direction and may engage the bag 100 where the back surface 102 and the left surface 112 intersect. Some of the anchors 118 may be biased toward a top surface 106 and other anchors 118 biased toward a bottom surface 108. The anchors 118 may be positioned in such a manner to allow for stable carrying of the bag 100 in either a first configuration 101 or second configuration (e.g. near the four corners of the bag). Anchors 118 may be substantially triangular in shape and engage the at least one strap on a side separate from the side of the anchor 118 that is secured to the bag 100. The anchors 118, or sutures, may be secured to the bag 100 by sewing, welding, ultrasonic welding, laser welding, stamp heat welding, hot plate welding, gluing, taping, one piece woven, and other fabric joining techniques known by those having skill in the art.

The at least one strap may be a first strap 120 and a second strap 122. The first strap 120 may be separate from the second strap 122. The first strap 120 may include a first end 124, an intermediate portion 126, and a second end 128. Each end 124, 128 of the first strap 120 may engage a separate anchor 118 of the bag 100. The first end 124 may engage a first anchor 118*a* of the bag 100 toward the top surface 106 and the right surface 110. The second end 128 may engage the bag 100 toward the top surface 106 with the intermediate portion 126 engaging a second anchor 118*b*. The second end 128 may be secured to the bag 100 where the back surface 102 and top surface 106 intersect. The second end 128 may be secured to the bag 100 by sewing, welding, ultrasonic welding, laser welding, stamp heat welding, hot plate welding, gluing, taping, one piece woven, and other fabric joining techniques known by those having skill in the art. The first end 124 and second end 128 may engage the bag 100 in different positions on the bag 100. The intermediate portion 126 of the first strap 120 may extend the length of the first strap 120 from the first end 124 to the second end 128.

Figure 3:
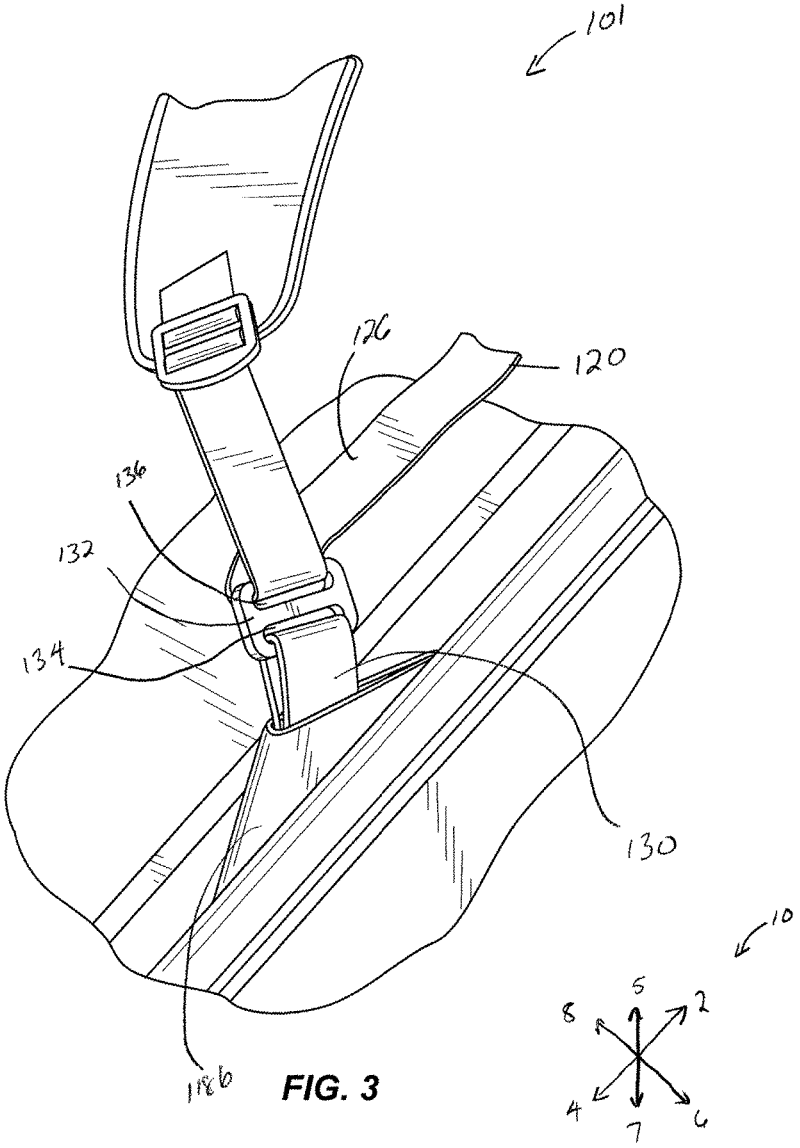
FIG. 3 is a cutout magnified view of one of the straps engaged with an anchor on the system, or bag, of FIG. 1 in a first configuration.
Figure 4:
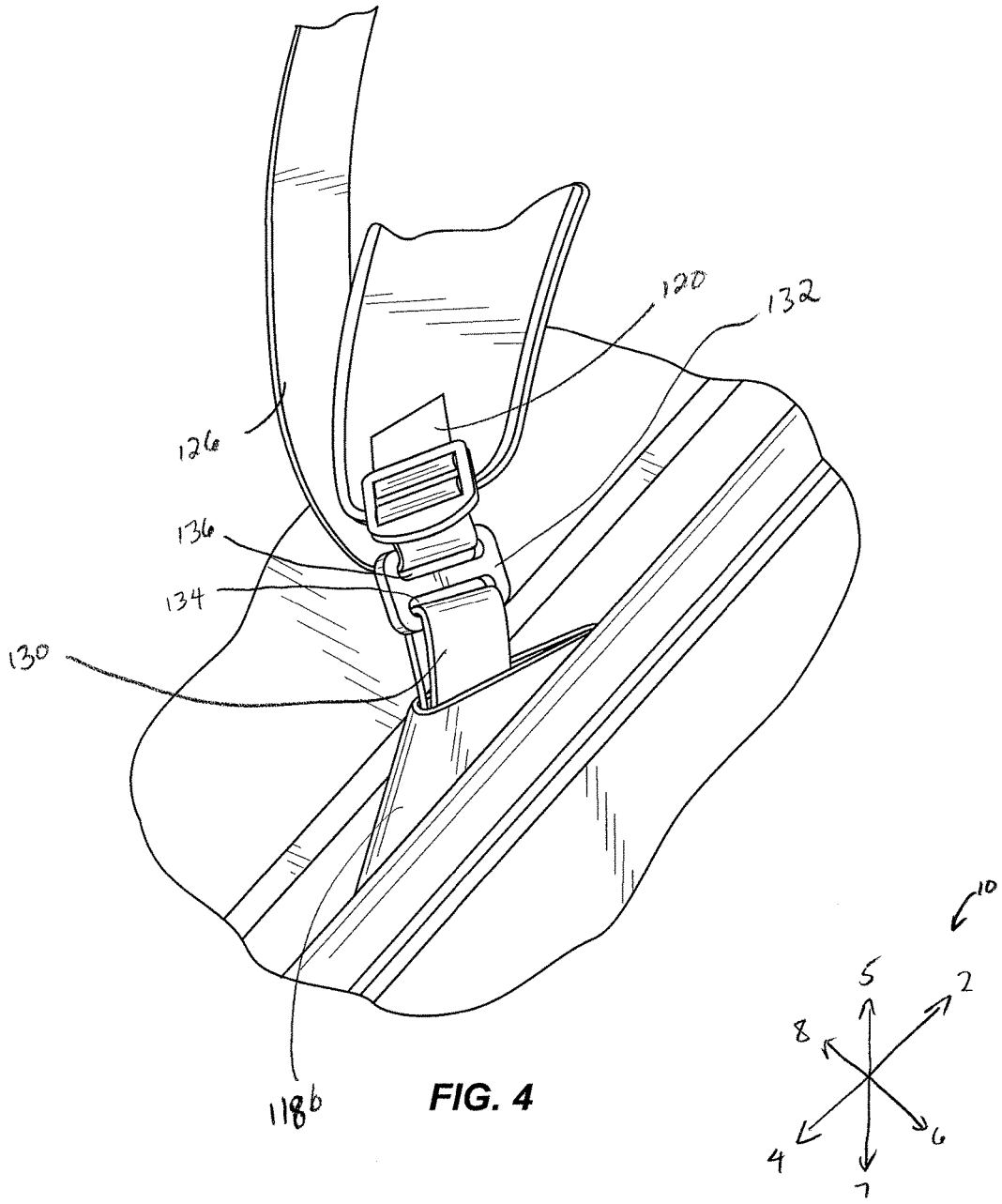
FIG. 4 is a cutout magnified view of one of the straps engaged with an anchor on the system, or bag, of FIG. 1 in a second configuration.
Figure 5:
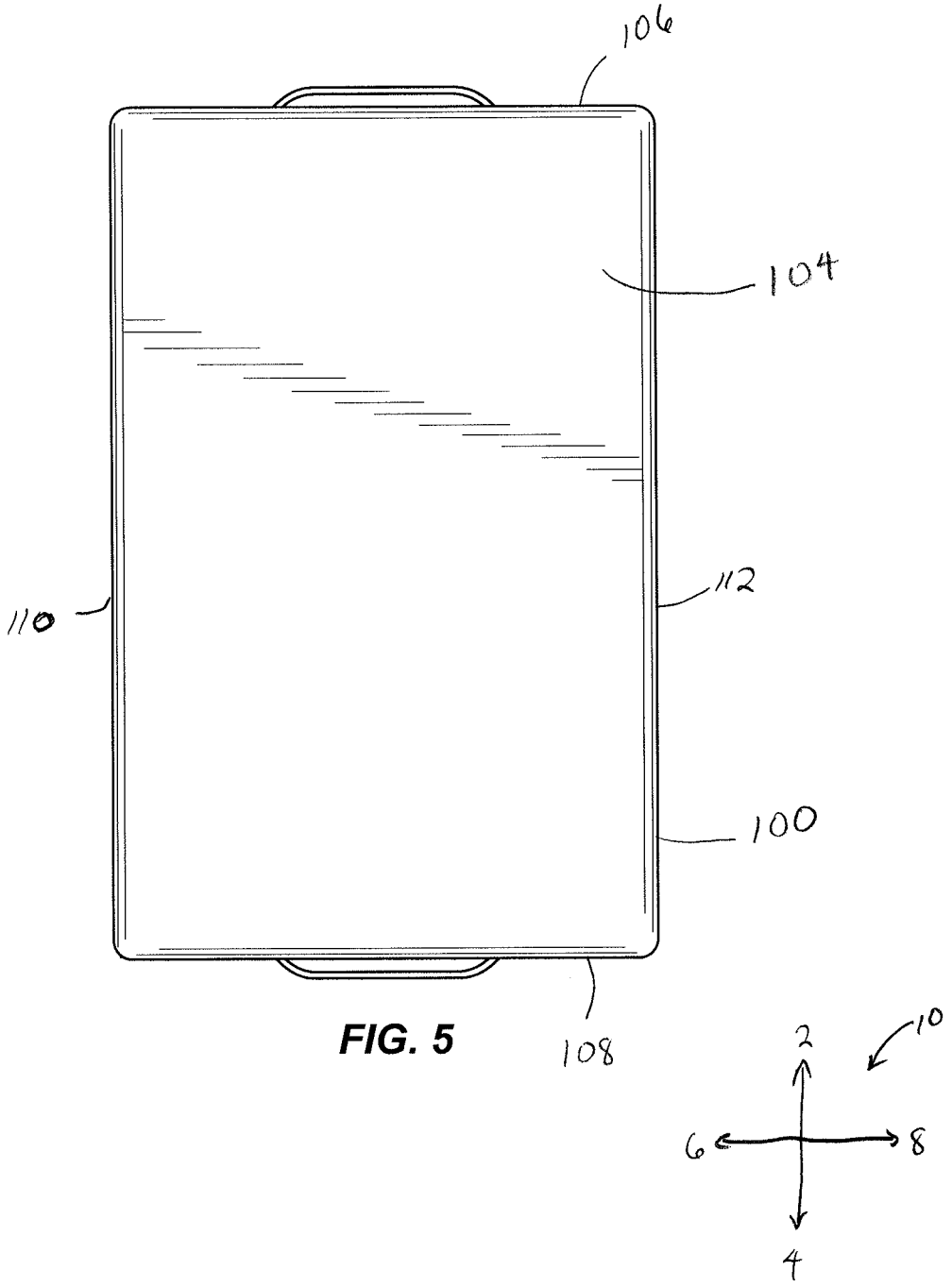
FIG. 5 is a front view of the system, or bag, of FIG. 1.

Referring to FIGS. 3 and 4, the second anchor 118*b* may include a third strap 130, or looped material, that is secured on both ends of the third strap 130 to the second anchor 118*b*, the third strap 130 forming a loop. The third strap 130 passes through a first clip 132, or first plate, or first ring, with the first clip 132 including a first aperture 134 and a second aperture 136. The third strap 130 passes through the first aperture 134 securing the first clip 132 to the second anchor 118*b*. The second aperture 136 engages the intermediate portion 126 of the first strap 120 with the first strap 120 passing through the second aperture 136, thus securing the first strap 120 to the bag 100 at the second anchor 118*b*. The first clip 132 may be configured to allow the first strap 120 to freely pass through the second aperture 136 by pulling on either side of the first strap 120 on opposite sides of the first clip 132. The first strap 120 may freely slide through the second aperture 136 of the first clip 132 or the first strap 120 is slidably connected or engaged to the first clip 132.

The first strap 120 may also include a handle portion 138 that is secured to the intermediate portion 126 of the first strap 120. The handle portion 138 may include snaps, buttons, a zipper, or other securing feature that may allow the handle portion 138 to hold the second strap 122 along with the first strap 120 when in a second configuration 103. The handle portion 138 may be secured to the intermediate portion 126 by sewing, welding, ultrasonic welding, laser welding, stamp heat welding, hot plate welding, gluing, taping, one piece woven, and other fabric joining techniques known by those having skill in the art.

The same or similar means for securing the first strap 120 are utilized in securing the second strap 122 to the bag 100. The second strap 122 also includes a first end 140, an intermediate portion 144 and a second end 146. The first end 140 of the second strap 122 may engage a third anchor 118*c* of the bag 100 toward the top surface 106 and the left surface 112. The second end 146 of the second strap 122 may engage the bag 100 toward the top surface 106 with the intermediate portion 144 of the second strap 122 engaging a fourth anchor 118*d*. The second end 146 may be secured to the bag 100 where the back surface 102 and top surface 106 intersect, but in a different location than the second end 128 of the first strap 120. The second end 146 may be secured to the bag 100 by means previously set forth herein. The first end 140 and second end 146 may engage the bag 100 in different positions on the bag 100. The intermediate portion 144 of the second strap 122 may extend the length of the second strap 122 from the first end 140 to the second end 146.

Referring to FIG. 2, each of the second ends 128 and 146 of the first and second straps 120, 122, respectively, are secured at different location on the bag 100. Each of the second ends 128, 146 are secured lateral to a medial line of the bag 100 (i.e. the first strap 120 second end 128 is biased toward the right side and the second strap 122 second end 146 is biased toward the left side).

Similar to the second anchor 118*b*, the fourth anchor 118*d* may include a fourth strap 148, or looped material, that is secured on both ends of the third strap 130 to the fourth anchor 118*d*, the fourth strap 148 forming a loop. The fourth strap 148 passes through a second clip 150, or second plate, or second ring, with the second clip 150 including a first aperture 152 and a second aperture 154. Similar to the first clip 132 apertures 134, 136 the second clip 150 apertures 152, 154 may also comprise elongated holes. The fourth strap 148 passes through the first aperture 152 of the second clip securing the second clip 150 to the fourth anchor 118*d*. The second aperture 154 of the second clip 150 engages the intermediate portion 144 of the second strap 122 with the first strap 120 passing through the second aperture 154 of the second clip 150, thus securing the second strap 122 to the bag 100 at the fourth anchor 118*d*.

The second clip 150 may be configured to allow the second strap 122 to freely pass through the second aperture 154 of the second clip 150 by pulling on either side of the second strap 122 on opposite sides of the second clip 150. The second strap 122 may freely slide through the second aperture 154 of the second clip 150, or the second strap 122 is slidably connected or engaged to the second clip 150.

The system 20 may further include sleeves 156. Each of the first strap 120 and second strap 122 may pass through the sleeves 156 that allows an intermediate portion 126 and 144, respectively, to pass through the sleeve 156. Each sleeve 156 may include padding, may be wider that the first and second straps 120, 122 and may be utilized for comfort of a user when carrying the bag 100 in the first configuration 101. Further, the system 20 may also include adjustment clips 158. Each of the first strap 120 and second strap 122 may engage an adjustment clip 158 that allows a user to adjust the length of the first strap 120 and/or second strap 122 independent of the other strap.

Referring to FIG. 3 (and in connection with FIGS. 1 and 2), the first strap 120 is biased toward a second end 128 in a first configuration 101. A greater amount of the intermediate portion 126 is between the first clip 132 and the second end 128. Although not depicted in FIG. 3, similarly the second strap 122 is biased toward a second end 146 in a first configuration 101. A greater amount of the intermediate portion 144 of the second strap 122 is between the second clip 150 and the second end 146 of the second strap 122. The first configuration 101 allows a user to carry the bag 100 easily and freely as a backpack because the straps 120, 122 allow a user to place their shoulders and arms between the straps 120, 122 and the bag 100.

In the first configuration 101, a portion of the intermediate portions 126, 144 of the respective first and second straps 120, 122 may lay flat against the back surface 102 of the bag 100. The portion of the intermediate portions 126, 144 of the respective first and second straps 120, 122 may be taut between the respective first clip 132 and first anchor 118*a* as well as between the second clip 150 and third anchor 118*c*.

Referring to FIG. 4 (and in connection with FIG. 10), the first strap 120 is biased toward a first end 124 in a second configuration 103. A greater amount of the intermediate portion 126 is between the first clip 132 and the first end 124. Although not depicted in FIG. 3, similarly the second strap is biased toward a first end 142 in a second configuration 103. A greater amount of the intermediate portion 144 of the second strap 122 is between the second clip 150 and the first end 142 of the second strap 122. The second configuration 103 allows a user to carry the bag 100 easily and freely as a duffle bag because the straps 120, 122 allow a user to hold the bag 100 with the handle portion 138 engaging both the first strap 120 and second strap 122 (see FIG. 10). The handle portion 138 may easily accommodate the second strap 122 along with the first strap 120 that the handle portion 138 is already integrated with. The second strap 122 may lay flush with the first strap 120 allowing the handle portion 138 to snap closed easily, creating a single point of contact for a user to carry the bag 100.

In the second configuration 103, a portion of the intermediate portions 126, 144 of the respective first and second straps 120, 122 may lay flat against the back surface 102 of the bag 100. The portion of the intermediate portions 126, 144 may be those portions passing through the sleeves 156. The portion of the intermediate portions 126, 144 of the respective first and second straps 120, 122 may be taut between the respective first clip 132 and first end 124 secured to the bag 100, as well as between the second clip 150 and the first end 142 secured to the bag 100. Alternatively, the portion of the intermediate portions 126, 144 of the respective first and second straps 120, 122 may have a greater amount of slack between the respective first clip 132 and first anchor 118*a* as well as between the second clip 150 and third anchor 118*c*. This greater amount of slack allows a user to easily and freely carry the bag 100 as a duffle bag.

Transitioning from a first configuration 101 to a second configuration 103 is performed by pulling on the respective straps 120, 122 on either side of the respective clips 132 and 150, depending on which configuration you wish to enjoy. By pulling on the intermediate portions 126, 144 between the clips 132, 150 and where the second ends 128 and 146 are secured to the bag 100, the bag 100 is transformed into the first configuration 101. By pulling on the intermediate portions 126, 144 between the clips 132, 150 and where the first ends 124, 142 are anchored (at anchors 118*a* and 118*c* respectively) to the bag 100, the bag 100 is transformed into the second configuration 103.

The straps 120, 122 pass freely through their respective clips 132, 150. The second apertures 136, 154 are sized and shaped to allow the straps 120, 122 to pass through these elongated holes without catching or requiring adjustment to the clips 132, 150, the straps 120, 122, or the anchors 118. The clips 132, 150 may be any suitable material including wood, metal, or plastic that is robust enough to withstand the passing of straps through it on a regular basis while maintaining its strength and durability.

The straps 120, 122 may be comprised of any suitable, durable material, such as nylon, webbing, or other fabrics well known for bags and travel bags. Similar to the clips 132, 150 the adjustable clips 158 may be made of similar plastics, wood, metal, or other material. The bag 100 may be comprised of any fabric or material typical for bags and travel bags which may include nylon including other waterproof materials.

While the above disclosure utilizes multiple straps it is considered and contemplated that the system 20 could function similarly with a single strap. Furthermore, while the present embodiment depicts one or more embodiments for a bag or travel bag, alternatives are contemplated herein specifically with regard to dimensions and materials and are considered part of this disclosure.

Although the foregoing disclosure provides many specifics, these should not be construed as limiting the scope of any of the ensuing claims. Other embodiments may be devised which do not depart from the scopes of the claims. Features from different embodiments may be employed separately or in combination. Accordingly, all additions, deletions, and modifications to the disclosed subject matter that fall within the scopes of the claims are to be embraced thereby. The scope of each claim is indicated and limited only by its plain language and the full scope of available legal equivalents to its elements.

What is claimed:

1. A system comprising:

a bag comprising: a plurality of openings, a left surface, a right surface, a back surface, a front surface, a top surface and a bottom surface; and a set of straps secured to the bag, wherein the set of straps comprise a first strap and a second strap, wherein the first strap is secured at three positions on the bag comprising:

a first position where the right surface of the bag and the back surface of the bag intersect;

a second position where the right surface of the bag and the back surface of bag intersect and separate from the first position; and a third position where the top surface of the bag and the back surface of the bag intersect;

wherein the second strap is secured at three positions on the bag comprising:

a fourth position where a left surface of the bag and the back surface of the bag intersect;

a fifth position where a left surface of the bag and the back surface of the bag intersect where a left surface of the bag and the back surface of the bag intersect separate from the fourth position; and a sixth position where the top surface of the bag and the back surface of the bag intersect, separate from the third position;

wherein each strap comprised a first end, a second end and an intermediate portion, wherein each intermediate portion passes through a separate plate, each plate attached at one of the securement positions of the respective strap, and a separate handle portion secured to at least one of the intermediate portions;

wherein each intermediate portion may pass through the separate plates in either direction, wherein pulling the set of straps in a first direction relative to the separate plates positions the bag in a first configuration and pulling the set of straps in a separate second direction relative to the separate plates positions the bag in a second configuration wherein the first strap and the second strap are capable of taking on a first configuration and a second configuration by sliding the first strap and the second strap through the plates, wherein in the first configuration the intermediate portion of each strap on one side of the plate forms a shoulder strap to enable wearing the travel bag as a backpack, and in the second configuration the intermediate portions of each strap on the other side of the plate together form a handle for carrying the travel bag by hand.

2. The system of claim 1, wherein the first configuration of the bag is a backpack.

3. The system of claim 1, wherein the second configuration of the bag is a duffel bag.

4. The system of claim 1, wherein the separate plates each comprise at least one aperture for slidably engaging the set of straps.

5. The system of claim 4, wherein the separate plates each comprise a second aperture for separately engaging looped straps wherein each of the looped straps are separately anchored to the bag.

6. The system of claim 1, wherein each strap of the set of straps is secured to the bag at three separate points of contact on the bag.

7. A travel bag comprising:

a plurality of pockets;

a first strap secured to the travel bag in at least three locations on a back surface of the travel bag;

a second strap separate from the first strap wherein the second strap is secured to the travel bag in at least three locations on the back surface of the travel bag and separate from the three locations of the first strap;

one of the first strap securement locations including a first plate with a first aperture and a second aperture, wherein the first plate slidably engages with the first strap through one of the first or the second aperture the first strap having a first segment on one side of the plate and a second segment on the other side of the plate; and one of the second strap securement locations including a second plate separate from the first plate, the second plate with a first aperture and a second aperture, wherein the second plate slidably engages with the second strap through one of the first or the second aperture the second strap having a first segment on one side of the plate and a second segment on the other side of the plate;

wherein the first strap and second strap are movable into a first configuration and a second configuration by pulling the first strap and the second strap, wherein the first strap and second strap are solely anchored on the back surface of the travel bag in both configurations; wherein in the first configuration the first segment of each strap forms a shoulder strap to enable wearing the travel bag as a backpack, and in the second configuration the second segments of each strap together form a handle for carrying the travel bag by hand.

8. The travel bag of claim 7, wherein the first strap passes through the first plate in a first direction and the second strap passed through the second plate in the first direction to put the bag in the first configuration.

9. The travel bag of claim 7, wherein the first strap passes through the first plate in a second direction and the second strap passed through the second plate in the second direction to put the bag in the second configuration.

10. The travel bag of claim 7, wherein the first plate engages a first looped material in the other of one of the first aperture or the second aperture, wherein the looped material is secured to the travel bag; and wherein the second plate engages a second looped material in the other of one of the first aperture or the second aperture of the second plate, wherein the second looped material is secured to the travel bag at a position separate from the first looped material.

11. A system comprising:

a bag comprising: at least one opening, a back panel, a front panel, a top panel, a bottom panel, a first side panel and a second side panel;

a first anchor point positioned between the top panel and the back panel;

a second anchor point positioned between the first side panel and the back panel, wherein the second anchor point is disposed closer toward the bottom panel than the top panel;

a third anchor point positioned between the first side panel and the back panel, separate from the second anchor point, wherein the third anchor point is disposed closer toward the top panel than the bottom panel;

a first strap secured to the first anchor point, the second anchor point and the third anchor point;

a fourth anchor point positioned between the top panel and the back panel separate from the first anchor point;

a fifth anchor point positioned between the second side panel and the back panel, wherein the fifth anchor point is disposed closer toward the bottom panel than the top panel;

a sixth anchor point positioned between the second side panel and the back panel, separate from the fifth anchor point, wherein the sixth anchor point is disposed closer toward the top panel than the bottom panel;

a second strap secured to the fourth anchor point, the fifth anchor point and the sixth anchor point;

wherein the first strap is configured to slidably engage the second anchor point and the second strap is configured slidably engage the fifth anchor point to allow the bag to transition between at least two configurations the second anchor point dividing the first strap into first and second segments and the fifth anchor point dividing the second strap into first and second segments; wherein in the first configuration the first segment of each strap forms a shoulder strap to enable wearing the travel bag as a backpack, and in the second configuration the second segments of each strap together form a handle for carrying the travel bag by hand.

* * * * *